US012029341B2

(12) United States Patent
Roberts et al.

(10) Patent No.: US 12,029,341 B2
(45) Date of Patent: Jul. 9, 2024

(54) REPLACEABLE CURTAIN SYSTEM

(71) Applicant: BEXT Solutions, LLC, St. Louis, MO (US)

(72) Inventors: Benjamin Scott Roberts, St. Louis, MO (US); Kenneth H. Murer, St. Louis, MO (US); Austin Cibulka, St. Louis, MO (US)

(73) Assignee: BEXT SOLUTIONS, LLC, St. Louis, MO (US)

( * ) Notice: Subject to any disclaimer, the term of this patent is extended or adjusted under 35 U.S.C. 154(b) by 267 days.

(21) Appl. No.: 17/500,401

(22) Filed: Oct. 13, 2021

(65) Prior Publication Data

US 2022/0240707 A1 Aug. 4, 2022

Related U.S. Application Data

(63) Continuation of application No. 29/768,805, filed on Feb. 1, 2021.

(51) Int. Cl.
*A47H 13/06* (2006.01)
*A47H 1/18* (2006.01)

(52) U.S. Cl.
CPC ..... *A47H 13/06* (2013.01); *A47H 1/18* (2013.01)

(58) Field of Classification Search
CPC . Y10T 24/51; Y10T 24/3416; Y10T 24/3417; Y10T 24/1397; A47H 13/06; A47H 1/18
See application file for complete search history.

(56) References Cited

U.S. PATENT DOCUMENTS

| | | | |
|---|---|---|---|
| 2,852,831 | A | 9/1958 | Hanna |
| 3,137,027 | A | 6/1964 | Birkle |
| 4,967,823 | A | 11/1990 | Gagnon |
| 5,291,946 | A | 3/1994 | Ciriaci |
| 6,098,246 | A | 8/2000 | Moir |
| 6,321,821 | B1 | 11/2001 | Wünsche |
| 6,325,656 | B1 | 12/2001 | Fukuda et al. |
| 6,334,477 | B1 | 1/2002 | Moir |
| 8,307,499 | B2 | 11/2012 | Ruffo et al. |
| D671,783 | S | 12/2012 | Graneto, III |
| 8,397,346 | B2 | 3/2013 | Peters et al. |
| 8,479,800 | B2 | 7/2013 | Graneto et al. |
| D709,714 | S | 7/2014 | Graneto, III |
| 8,869,869 | B2 | 10/2014 | Graneto, III |
| 8,899,301 | B2 | 12/2014 | Graneto, III |
| 9,125,509 | B2 | 9/2015 | Graneto, III |

(Continued)

*Primary Examiner* — Robert Sandy
(74) *Attorney, Agent, or Firm* — Stinson LLP

(57) ABSTRACT

A buckle assembly for suspending a curtain from a support includes upper and lower buckle parts. The upper buckle part has a support connector for attaching the upper buckle part to the support and first and second finger rests. The first and second finger rest extend outward, in opposite directions. The first and second finger rests are sized and shaped to be engaged by respective first and second fingers of one hand of a user. The lower buckle part is attached to the curtain and includes a thumb receptacle sized and shaped to receive a thumb of the user. One of the upper buckle part or the lower buckle part includes a buckle part connector that engages the other of the upper buckle part or the lower buckle part to couple the upper and lower buckle parts together.

20 Claims, 9 Drawing Sheets

(56) References Cited

U.S. PATENT DOCUMENTS

| | | | | |
|---|---|---|---|---|
| 9,149,144 | B2 | 10/2015 | Graneto, III | |
| 9,585,508 | B2 | 3/2017 | Graneto, III | |
| D873,120 | S | 1/2020 | Couvion | |
| 10,966,558 | B2 | 4/2021 | Goelst | |
| 2001/0032379 | A1* | 10/2001 | Chang | A44B 11/266<br>24/614 |
| 2009/0250178 | A1 | 10/2009 | Ganzi | |
| 2009/0288786 | A1 | 11/2009 | Graneto, III et al. | |
| 2012/0018106 | A1 | 1/2012 | Robledo | |
| 2015/0136339 | A1 | 5/2015 | Bauer et al. | |
| 2015/0208843 | A1 | 7/2015 | Ruble | |
| 2018/0168382 | A1 | 6/2018 | Goelst | |
| 2020/0029719 | A1 | 1/2020 | McNabb et al. | |
| 2023/0127236 | A1 | 4/2023 | Olsen et al. | |
| 2023/0130071 | A1 | 4/2023 | Olsen et al. | |

* cited by examiner

REPLACEABLE CURTAIN SYSTEM

CROSS-REFERENCE TO RELATED APPLICATION

The present application claims the benefit of U.S. Design Application No. 29/768,805, filed Feb. 1, 2021, the entirety of which is hereby incorporated by reference.

FIELD

The present disclosure generally relates to devices for suspending a curtain and more particularly to a buckle assembly for suspending a curtain from a support.

BACKGROUND

In healthcare and hospitality spaces, such as hospitals, curtains are frequently movably suspended from ceilings. These curtains can be used to provide privacy and/or divide a space such as a room having two or more beds. Due to the health and cleaning requirements of healthcare and hospitality industries, these curtains are frequently taken down for cleaning or replacement with a new, clean curtain.

SUMMARY

In one aspect, a buckle assembly for suspending a curtain from a support comprises an upper buckle part having an upper buckle part body and a support connector attached to the upper buckle part body and configured to attach the upper buckle part to the support. The upper buckle part has first and second finger rests. The first finger rest extends outward from a first side of the upper buckle part body and the second finger rest extends outward from a second side of the upper buckle part body. The first finger rest is sized and shaped to be engaged by a first finger of a user and the second finger rest is sized and shaped to be engaged by a second finger of the user. A lower buckle part has a lower buckle part body configured to be attached to the curtain. The lower buckle part body includes a thumb receptacle sized and shaped to receive a thumb of the user. One of the upper buckle part or the lower buckle part includes a buckle part connector configured to engage the other of the upper buckle part or the lower buckle part to couple the upper and lower buckle parts together.

In another aspect, a curtain assembly for being suspended from a plurality of upper buckle parts comprises a curtain and a plurality of lower buckle parts attached to an upper edge margin of the curtain. Each lower buckle part includes a buckle part connector configured to engage one of the upper buckle parts to couple the plurality of lower buckle parts to the plurality of upper buckle parts. Each lower buckle part includes a thumb receptacle sized and shaped to receive and at least partially conform to a thumb of a user.

In another aspect, a method of installing a curtain system comprises supporting a lower buckle part by a thumb of one hand of a user, grasping an upper buckle part with first and second fingers of the one hand of the user, and connecting the upper and lower buckle parts together by squeezing the upper and lower buckle parts together with the thumb, first finger and second finger of the one hand of the user.

In another aspect, a method of detaching a movable privacy curtain used to selectively enclose an area within a hospital room from a ceiling support in a hospital comprises reaching up to a buckle assembly interconnecting the curtain with the ceiling support. The buckle assembly includes an upper buckle part and a lower buckle part. The upper buckle part is attached to the support. The lower buckle part is attached to the curtain. The upper and lower buckle parts are coupled to one another. The method includes squeezing first and second snap-fit elements of either the upper buckle part or the lower buckle part with a thumb and a finger of one hand of the user to release connection of the lower buckle part to detach a portion of the curtain from the ceiling support.

Other objects and features will be in part apparent and in part pointed out hereinafter.

BRIEF DESCRIPTION OF THE DRAWINGS

Corresponding reference characters indicate corresponding parts throughout the drawings.

DETAILED DESCRIPTION

Figure 1:
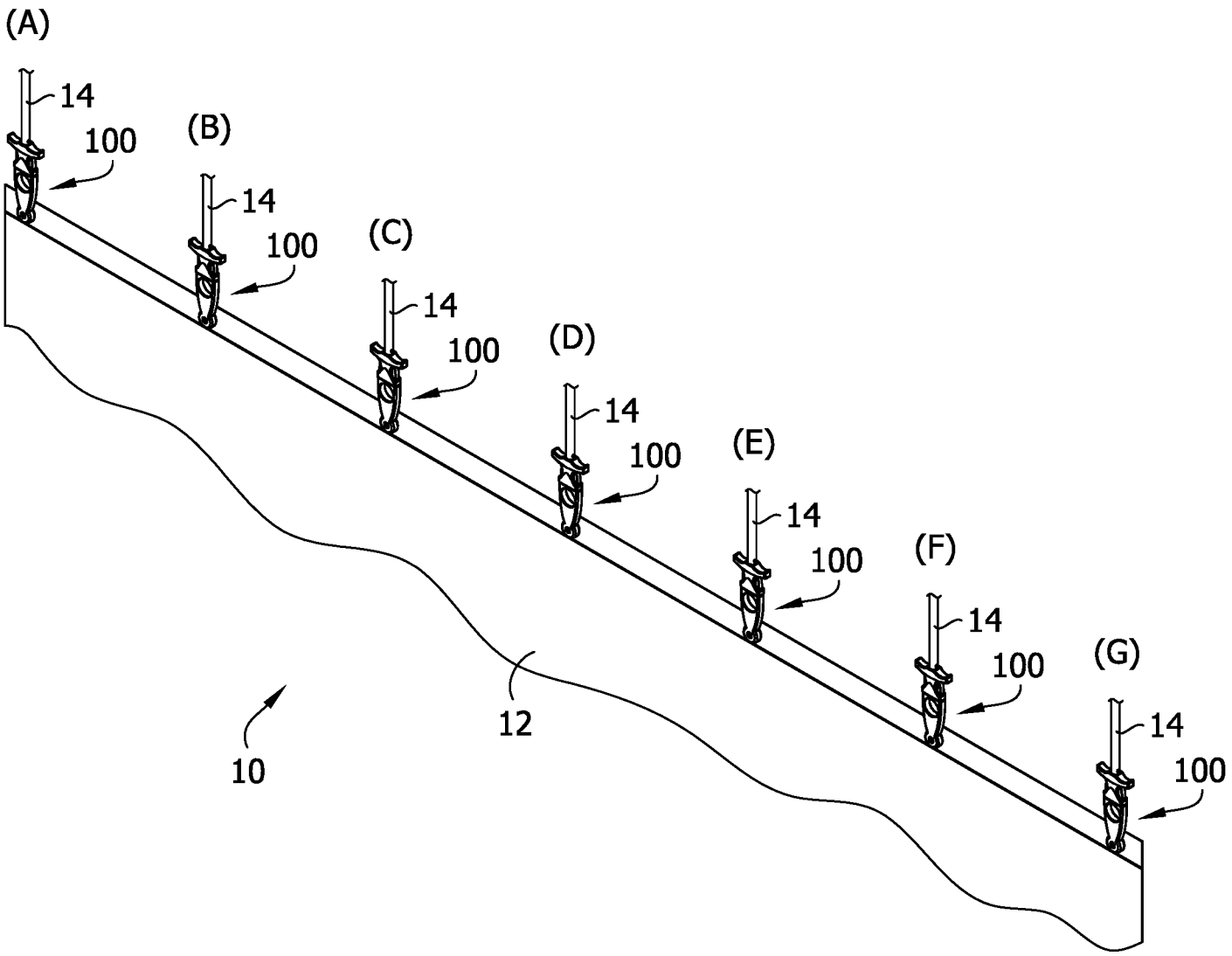
FIG. 1 is a fragmentary perspective of a curtain system according to one embodiment of the present disclosure.
Figure 2:
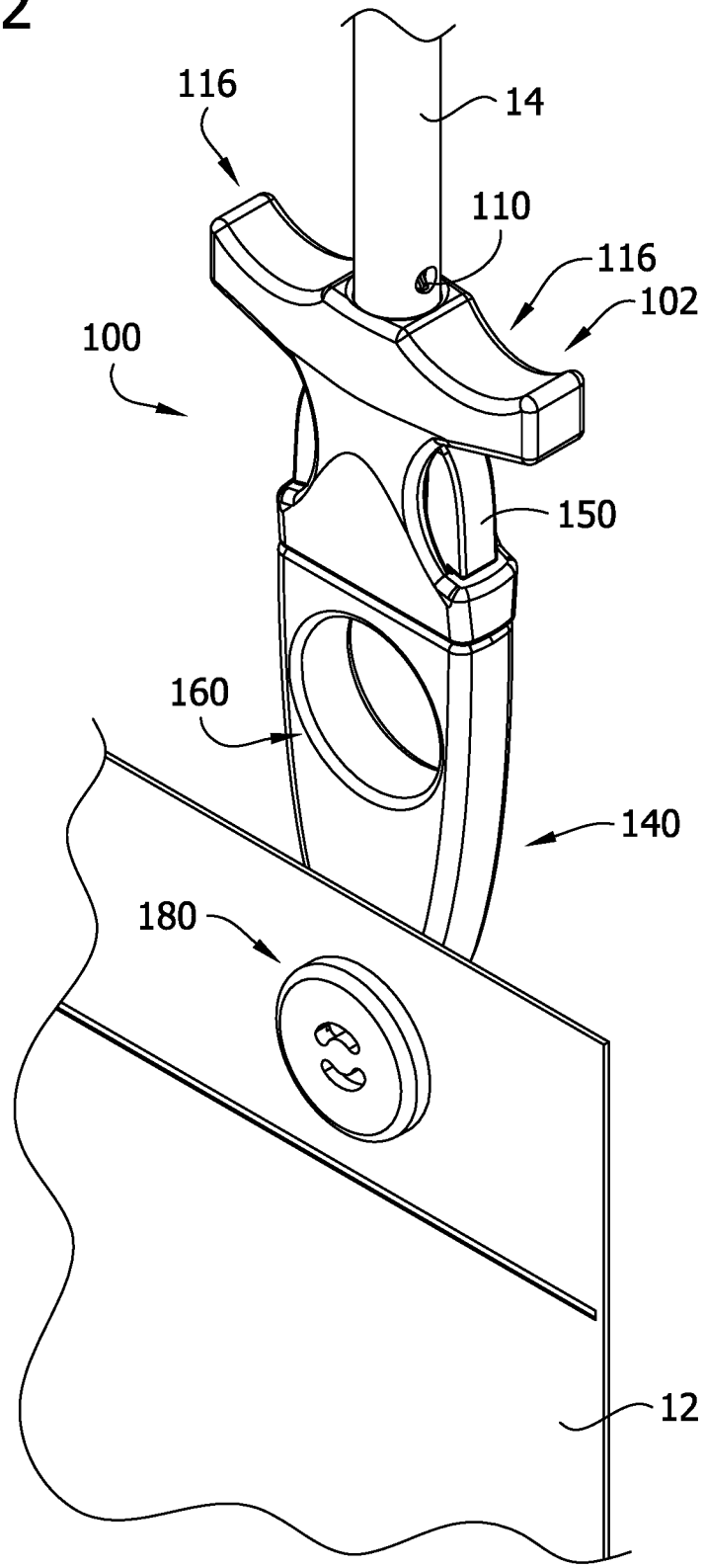
FIG. 2 is an enlarged view of the curtain system of FIG. 1.

Referring to FIGS. 1 and 2, a buckle assembly according to one embodiment of the present disclosure is generally indicated by reference numeral 100. The buckle assembly 100 is part of a curtain system, generally designated by reference numeral 10. The curtain system 10 includes a curtain 12, a plurality of supports 14, and a plurality of buckle assemblies 100 connecting the curtain to the supports. In the illustrated embodiment, the curtain system 10 includes seven buckle assemblies and seven supports, although more or fewer buckle assemblies and supports are within the scope of the present disclosure. The buckle assemblies 100 are all identical. The buckle assemblies 100 connect the curtain 12 to the supports 14, thereby suspending the curtain from the supports. The supports 14 (e.g., ceiling supports) are connected to and suspended from a building structure, such as a ceiling (not shown), as generally known in the art. The supports 14 are movable along the building structure to enable the curtain 12 to be selectively moved (e.g., extended, collapsed, positioned, etc.) as desired. For example, the curtain 12 (e.g., a movable privacy curtain) can be extended to selectively enclose or divide an area within a hospital room or collapsed and stored until needed by moving the supports 14. In the illustrated embodiment, the supports 14 comprise cylindrical rods or tubes, although other configurations of the supports are within the scope of the present disclosure. The upper ends of the rods 14 can each be connected to a roller that rides in a track mounted on the ceiling (not shown). Thus, the rods 14 are movable independently of each other until they are attached to the curtain.

Figure 3:
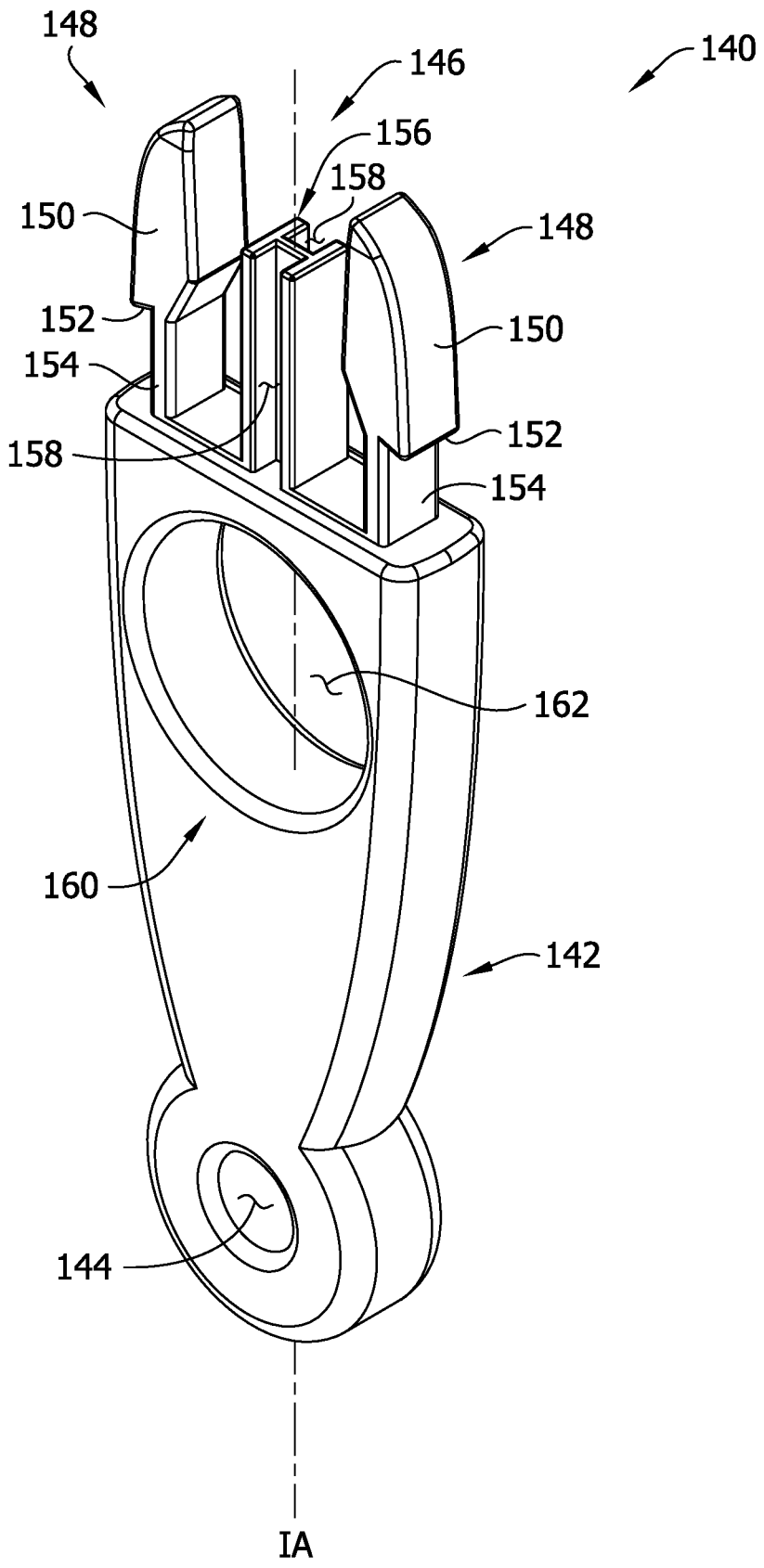
FIG. 3 is a perspective of a lower buckle part of a buckle assembly according to one embodiment of the present disclosure.
Figure 4:
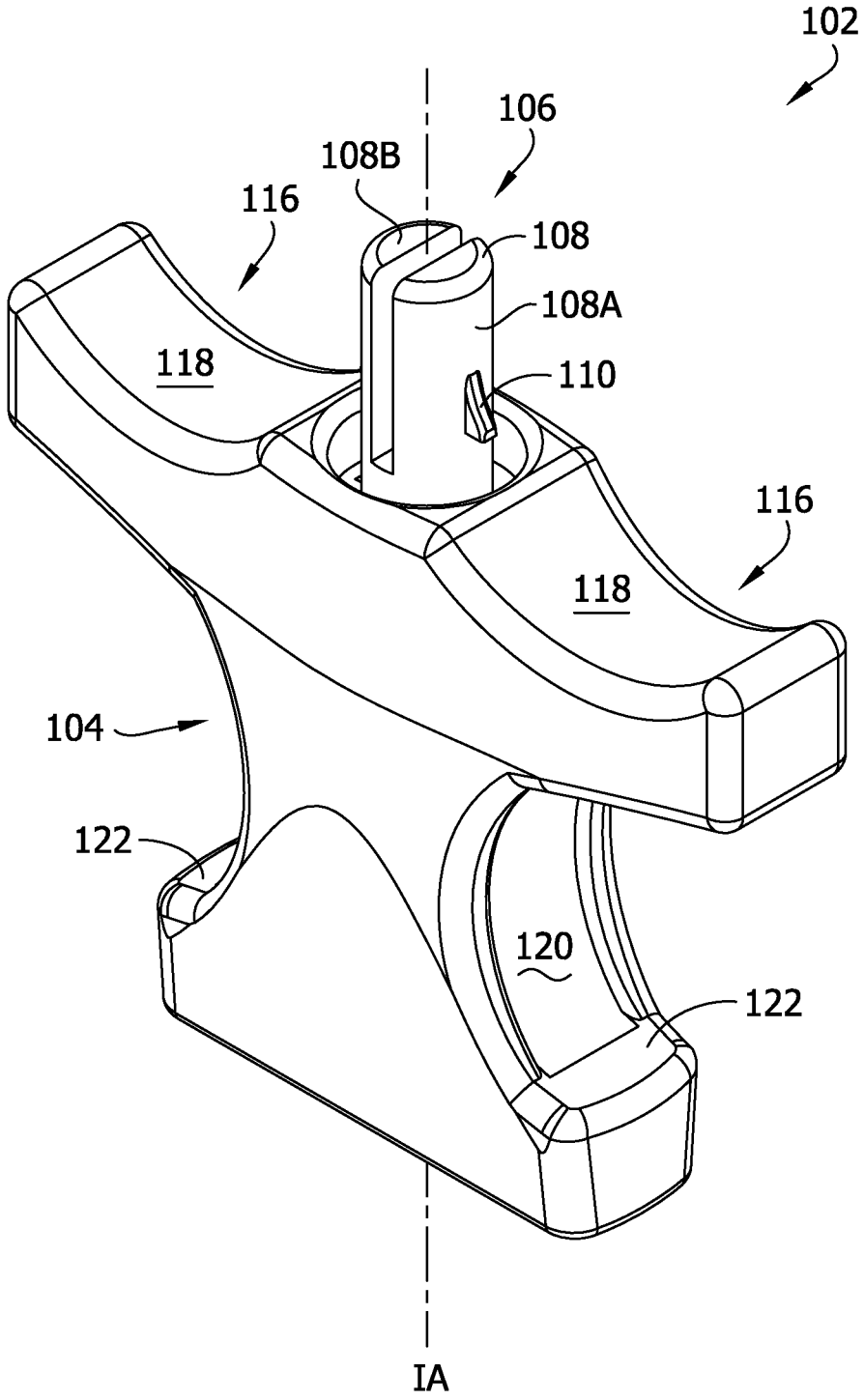
FIG. 4 is a perspective of an upper buckle part of the buckle assembly according to one embodiment of the present disclosure.
Figure 5:
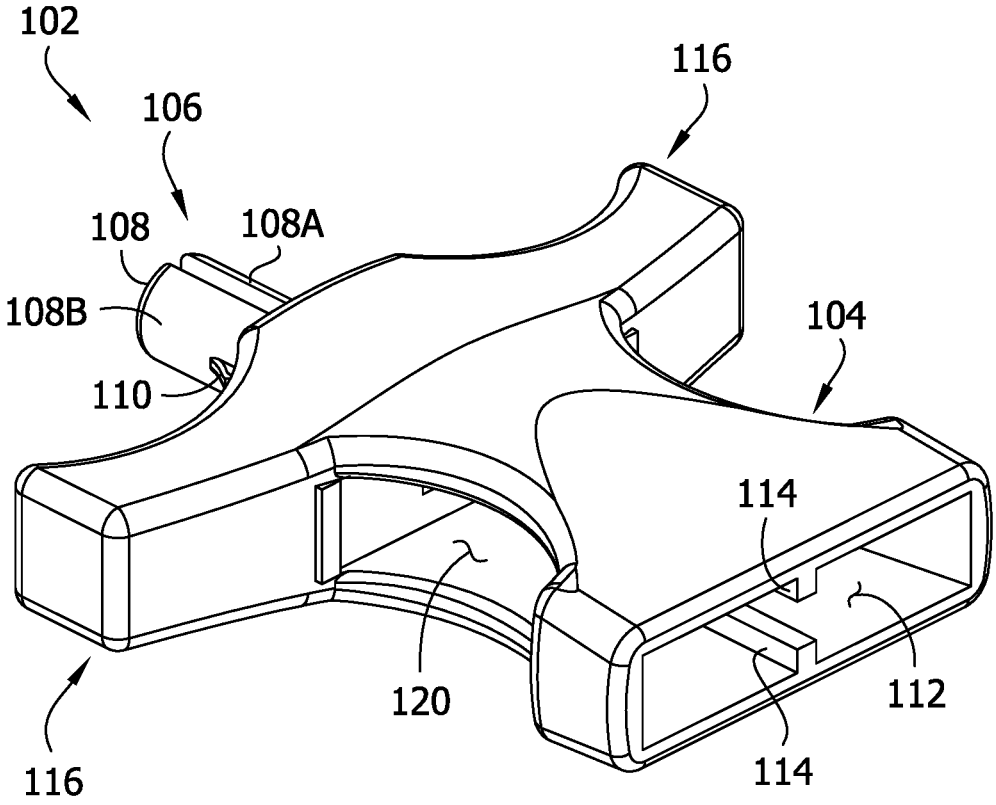
FIG. 5 is a perspective of the upper buckle part from a bottom side vantage.
Figure 6:
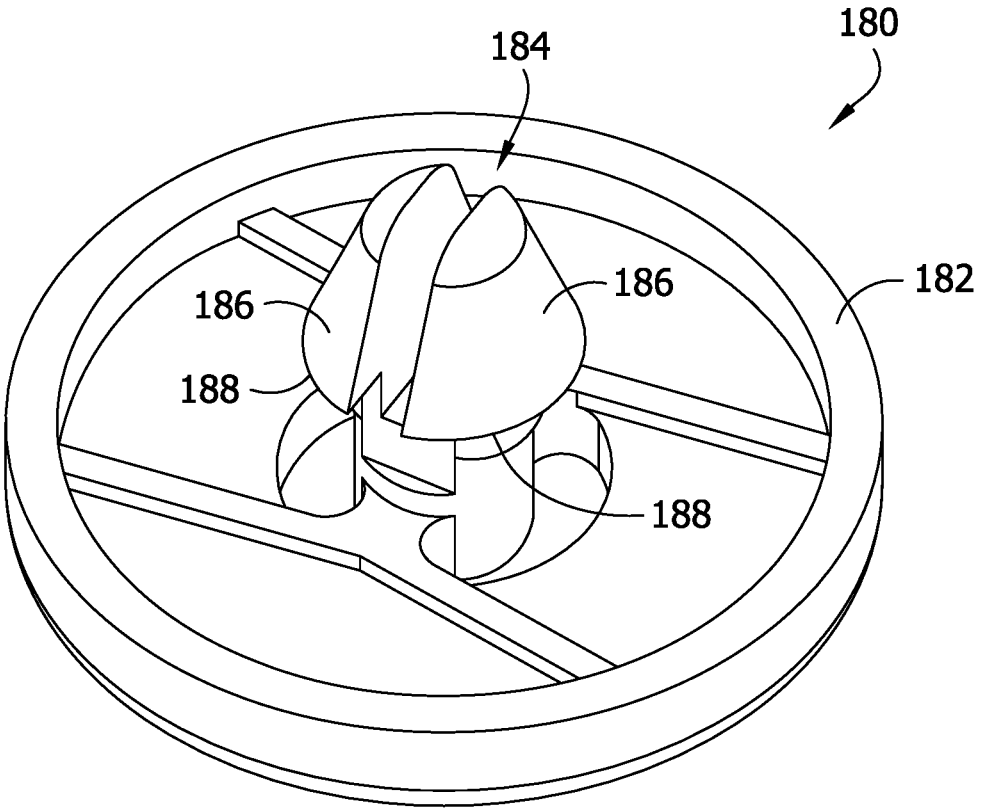
FIG. 6 is a perspective of a curtain connector of the buckle assembly according to one embodiment of the present disclosure.

Referring to FIGS. 2-6, the buckle assembly 100 includes a first or upper buckle part 102 and a second or lower buckle part 140. The upper buckle part 102 includes an upper buckle part body 104 (FIGS. 4 and 5). The upper buckle part 102 also includes a support connector 106 attached to the upper buckle part body 104. The support connector 106 is configured to attach to the rod 14 to attach the upper buckle part 102 to the support. In the illustrated embodiment, the support connector 106 is configured to be inserted into a hollow (not shown) end of the rod 14. The support connector 106 includes a post 108 configured to be inserted into the rod 14 (e.g., an open lower end thereof). The support connector 106 has a pair of latch members 110 (broadly, "at least one latch member"). Each latch member 110 is configured to engage and form a latched connection with the rod 14 to attach the support connector 106 (broadly, the upper buckle part 102) to the rod. In the illustrated embodiment, each latch member 110 comprises a detent or catch configured to extend into a corresponding opening in the rod 14 to secure the support connector 106 to the support. In the illustrated embodiment, the support connector 106 includes two (e.g., first and second) latch members 110. The post 108 includes first and second spaced apart post segments 108A, 108B. Each post segment 108A, 108B supports one of the latch members 110. The post segments 108A, 108B are resiliently deflectable to enable the post segments 108A, 108B to deflect inward to allow the post 108 to be inserted into the rod 14. The post segments 108A, 108B return to their original position when the latch members 110 become aligned with the openings in the rod 14, thereby latching the support connector 106 to the support. The latch members 110 each have a ramp shape to facilitate insertion into the open bottom of the rod 14, and deflection of the post segments 108A, 108B.

Referring to FIG. 3, the lower buckle part 140 includes a lower buckle part body 142. The lower buckle part body 142 is configured to be attached to the curtain 12. Specifically, the lower buckle part 140 is attached to an upper edge margin of the curtain 12. In the illustrated embodiment, the buckle assembly 100 includes a curtain connector 180 (FIG. 6) for attaching the curtain 12 to the lower buckle part 140. The curtain connector 180 attaches to the lower buckle part body 142 to attach the curtain 12 to the lower buckle part 140. The curtain connector 180 includes a disk 182 and a snap-fit connector 184 attached to the disk. The snap-fit connector 184 is configured to form a snap-fit connection with the lower buckle part body 142. The snap-fit connector 184 includes two resiliently deflectable snap-fit inserts 186, that together generally form a frustum of a cone. Each snap-fit elements or insert 186 defines a shoulder 188. The lower buckle part body 142 defines an opening 144 (e.g., a curtain connector opening). The snap-fit connector 184 of the curtain connector 180 is sized and shaped to be inserted into the opening 144. To attach the curtain 12 to the lower buckle part body 142, the snap-fit connector 184 of the curtain connector 180 is inserted into a hole or grommet (not shown) in the curtain and then into the opening 144. The lower buckle part body 142 deflects each snap-fit insert 186 as the snap-fit connector 184 is inserted into the opening 184. The lower buckle part body 142 includes a shelf (not shown) in the opening 144. Once the shoulders 188 of each snap-fit insert 186 are moved past the shoulder, the snap-fit inserts 186 return or snap-back to their original, undeflected positions. The engagement between the shoulders 188 and the shelf of the lower buckle part body 142 secure the curtain 12 and curtain connector 180 to the lower buck part 140.

The upper and lower buckle parts 102, 140 are releasably coupled together. Broadly, one of the upper or lower buckle parts 102, 140 includes a buckle part connector 146 configured to engage the other of the upper or lower buckle part to couple to the upper and lower buckle parts together. In the illustrated embodiment, the lower buckle part 140 includes the buckle part connector 146 (which then engages the upper buckle part 102), although in other embodiments, the upper buckle part can include the buckle part connector. The illustrated buckle part connector 146 is a snap-fit connector, although other types of connectors are within the scope of the present disclosure. The snap-fit connector 146 is configured to form a snap-fit connection with the upper buckle part 102 (broadly, said other of the upper or lower buckle parts 102, 140). The snap-fit connector includes two resiliently deflectable snap-fit elements or inserts 148. Each snap-fit insert 148 includes a detent or catch 150 defining a lip 152. Each snap-fit insert 148 includes a resiliently deflectable arm 154 connecting the detent 150 to the lower buckle part body 142. The upper buckle part body 104 defines a snap-fit connector receiving space 112 having an open lower end (FIG. 5). The snap-fit connector 146 of the lower buckle part 140 is sized and shaped to be inserted into the snap-fit connector receiving space 112 through the lower end. The buckle part connector 146 also includes a guide post 156. The guide post 156 defines two guide channels 158 (broadly, at least one guide channel), each having an open upper end. The upper buckle part 102 includes two guides 114 in the snap-fit connector receiving space 112. Each guide 114 is arranged, sized and shaped to be received in one of the guide channels 158 of the guide post 156 as the snap-fit connector 146 is inserted into the snap-fit connector receiving space 112 to guide the snap-fit connector into the snap-fit connector receiving space.

The upper and lower buckle parts 102, 140 of the buckle assembly 100 are configured to be connected together with one hand. This makes attaching the curtain 12 to the rods 14 much easier over conventional systems. Typically, the top of the curtain 12 is above head height (e.g., about 7 feet (about 2.1m) or more above the floor). Thus, being able to attach the curtain 12 to the rods 14 with one hand makes it substantially easier to quickly attach the curtain to the rods over conventional systems that require at least two hands. This is a significant efficiency in hospital environments where curtains are changed frequently. In the illustrated embodiment, the upper and lower buckle parts 102, 140 are coupled together by a claw grip of a user or operator. A "claw grip" uses of the thumb and two fingers of the same hand of the user to squeeze the components together (see, FIG. 7). Preferably, the two fingers are the pointer and index fingers, however any combination of the pointer, index, ring and pinky fingers can be used.

The upper buckle part 102 includes first and second finger rests 116. The first finger rest 116 extends outward from a first side of the upper buckle part body 104 and the second finger rest 116 extends outward from an opposite, second side of the upper buckle part body. The first finger 116 rest is sized and shaped to be engaged by a first (e.g., pointer) finger of the user and the second finger rest 116 is sized and shaped to be engaged by a second (e.g., middle) finger of the same hand of the user. Each finger rest 116 includes a finger support surface 118 (FIG. 4). Each finger support surface 118 is configured to be engaged by one of the fingers of the user. Each finger support surface 118 generally defines the upper end of the respective finger rests 116. In the illustrated embodiment, each finger support surface 118 is arcuate. In particular, each finger support surface 118 is concave to conform the finger support surface to the shape of the finger. This makes it easier to securely grip the finger rests 116.

Figure 7:
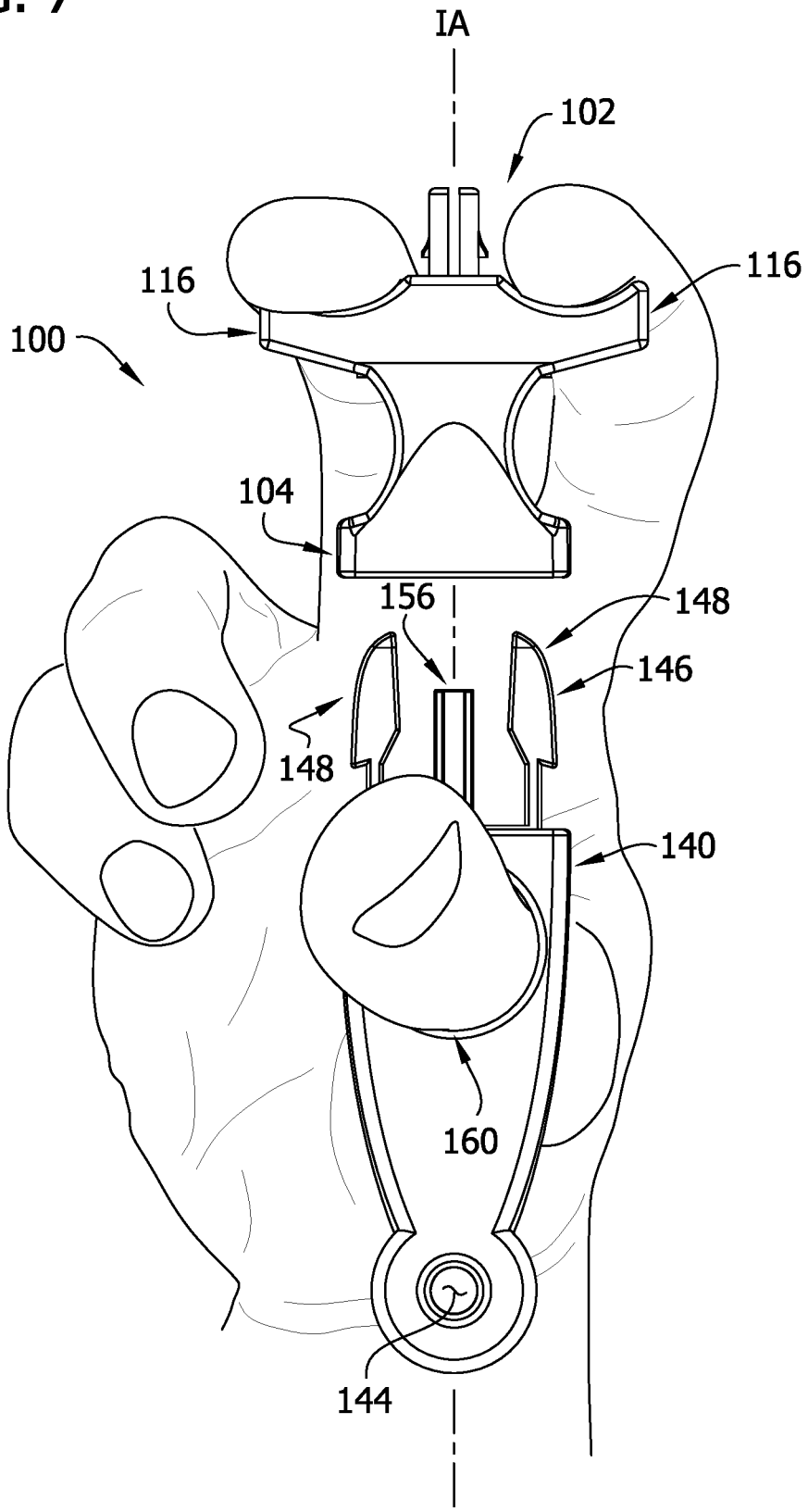
FIG. 7 is an illustration of a user connecting the upper and lower buckle parts of the buckle assembly together.

The lower buckle part 140 includes a thumb receptacle 160. The thumb receptacle 160 is sized and shaped to receive the thumb of the user. In the illustrated embodiment, the thumb receptacle 160 comprises a hole 162 in the lower buckle part 140. The hole 160 is defined by the lower buckle part body 142 and is generally disposed between the opening 144 and the buckle part connector 146. The hole 162 is sized and shaped to permit the thumb of the user to be inserted at least partially into or through the hole as shown in FIG. 7. Referring to FIG. 3, the thumb receptacle 160 at least partially conforms to the thumb of the user. The upper portion of the hole 162 is rounded to conform to the shape of the thumb of the user. In the illustrated embodiment, the hole 162 is generally circular. It will be understood that the thumb receptacle 160 may have other configurations. For example and without limitation, instead of the hole 162, the thumb receptacle 160 may comprise structure (not shown) projecting from the lower buckle body part 142. The projecting structure could be particularly shaped to allow gripping with the thumb.

The upper and lower buckle parts 102, 140 are generally symmetrical. In particular, the first and second finger rests 116 are symmetrical about an imaginary axis IA. The imaginary axis extends through the center of the thumb receptacle 160 when the upper and lower buckle parts 102, 140 are coupled together. Such a configuration facilitates the attachment of the upper and lower buckle parts 102, 140 together by minimizing any twisting that may occur between the upper and lower buckle parts as they are being connected.

Referring again to FIG. 7, a method of installing the curtain system 10 will now be described. Initially, each upper buckle part 102 is connected to one of the rods 14 via the support connector 106, as explained above. This can be done before or after the rod 14 is suspended from the ceiling. Next, the curtain 12 is attached to the upper buckle parts 102 by connecting each corresponding upper and lower buckle parts 102, 140 of the buckle assemblies 100. To couple one set of upper and lower buckle parts 102, 140, the lower buckle part is supported by the thumb of one hand of the user. The user inserts their thumb of the one hand into the thumb receptacle 160 of the lower buckle part 140 (e.g., inserts their thumb into the hole 162). The user then grasps the upper buckle part 102 with first and second fingers of the same hand. The user places one finger on the first finger rest 116 of the upper buckle part 102 and places the second finger on the second finger rest 116 of the upper buckle part. The user then connects the upper and lower buckle parts 102, 140 together by squeezing the upper and lower buckle parts together with the thumb, the first finger, and the second finger of the one hand of the user. In other words, the user connects the upper and lower buckle parts 102, 140 together with one hand using the claw grip. As the user squeezes the upper and lower buckle parts 102, 140 together with their thumb, first finger, and second finger, the snap-fit connection between the upper and lower buckle parts is formed. The buckle part connector 146 (e.g., snap-fit connector) is inserted into snap-fit connector receiving space 112 through the open lower end. As the upper and lower buckles parts 102, 140 are squeezed together, the upper buckle part body 104 deflects each snap-fit insert 148. Each detent 150 is engaged and moved by the upper buckle part body 104, thereby deflecting the corresponding arm 154 generally inward toward the other arm. The upper buckle part body 104 includes first and second detent openings 120 on each side thereof, with a shelf 122 at the lower end of each detent opening. Once the detents 150 of each snap-fit insert 148 become aligned with the corresponding detent opening 120, the arms 154 of each snap-fit insert resiliently returns or snaps back to their original, undeflected positions, thereby moving the detents outward into the detent openings. In this position, the lips 152 of each snap-fit insert 148 overlie a corresponding shelf 122 of the upper buckle part body 104 such that the engagement therebetween secures the upper and lower buckle parts 102, 140 together, attaching a portion of the curtain 12 to one of the rods 14. This process of connecting the upper and lower buckle parts 102, 140 together can be rapidly repeated for each buckle assembly 100 until all the buckle assemblies of the curtain system 10 are connected together and the curtain 12 is fully suspended from all the rods 14.

Figure 8:
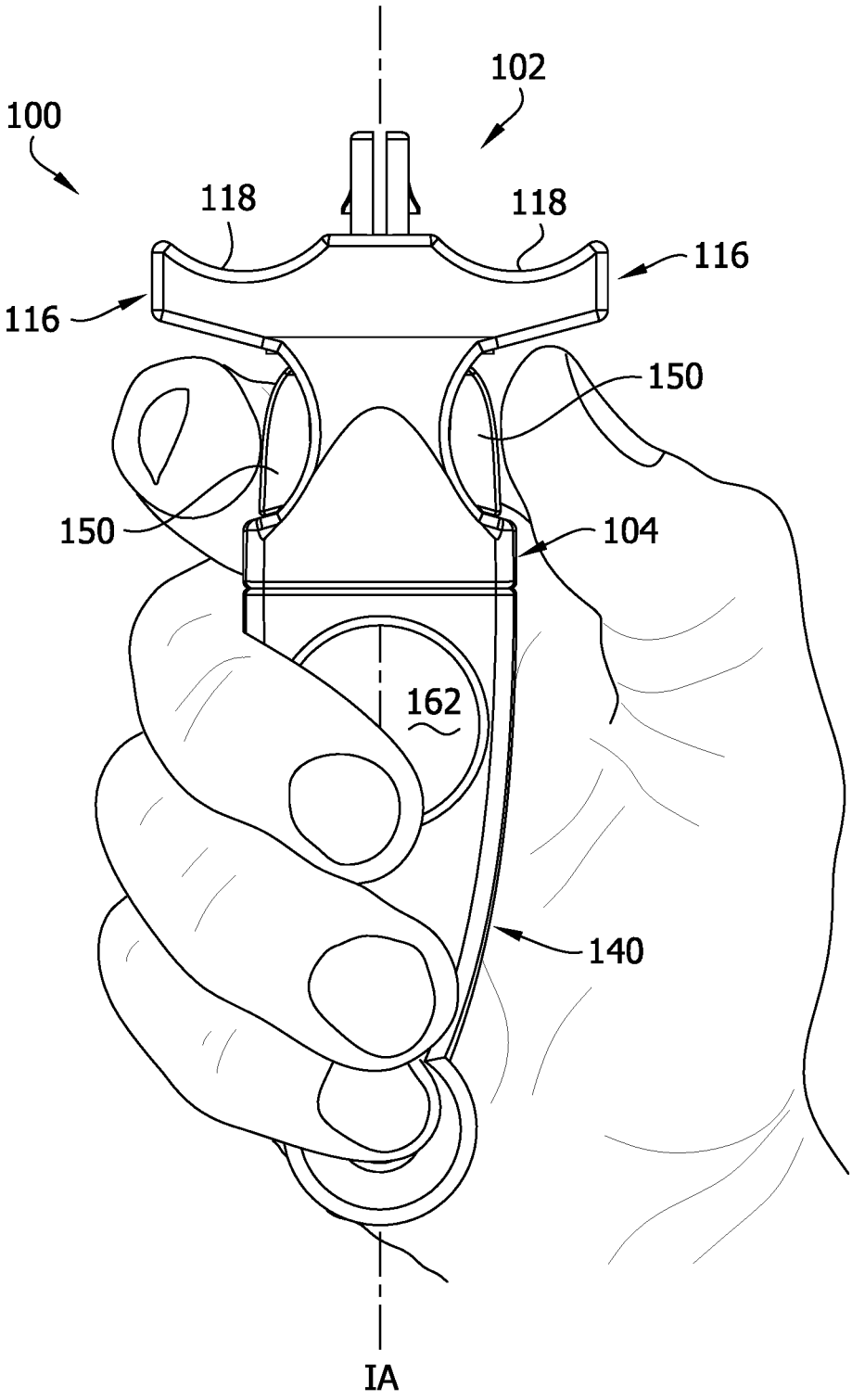
FIG. 8 is an illustration of a user disconnecting the upper and lower buckle parts of the buckle assembly from one another.

Referring to FIG. 8, the upper and lower buckle parts 102, 140 of the buckle assembly 100 are configured to be disconnected with one hand. This makes removing the curtain 12 from the rods 14 easier than with conventional systems that need at last two hands. To detach the curtain 12 from the rod 14, a user reaches up to one of the buckle assemblies 100 to decouple the upper and lower buckle parts 102, 140 from one another. Using a thumb and a finger of one hand, the user squeezes the first and second snap-fit inserts 148 to release the connection (e.g., snap-fit connection) of the lower buckle part 140 with the upper buckle part 102 to detach a portion of the curtain 12 from the one of the rods 14. The thumb and finger push the detents 150 inward, moving the lips 152 out of alignment with the shoulders 122 to allow the lips to move past the shoulders as the buckle part connector 146 is withdrawn from the upper buckle part body 104. This process of disconnecting the upper and lower buckle parts 102, 140 can be rapidly repeated for each buckle assembly 100 until all the buckle assemblies of the curtain system 10 are disconnected and the curtain 12 is removed from all the rods 14.

Figure 9:
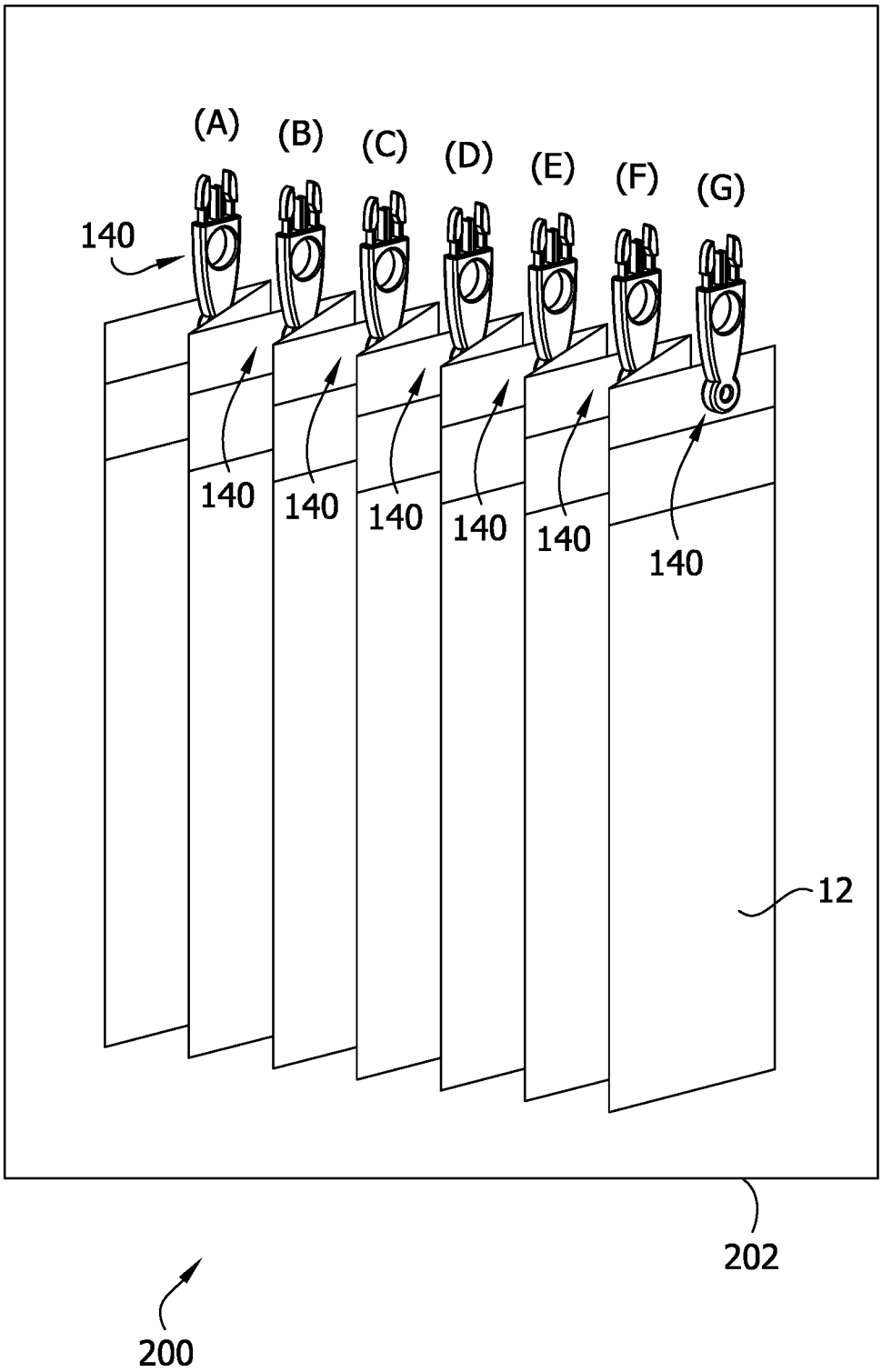
FIG. 9 is an illustration of a curtain assembly in a package.

Referring to FIG. 9, a curtain assembly 200 of the curtain system 10 is generally shown. The curtain assembly 200 includes the curtain 12 and the plurality of lower buckle parts 140 attached thereto. The curtain assembly 200 may be used to replace an existing curtain assembly within a space (e.g., a hospital room). As mentioned above, the buckle assembly 100 allows the curtain 12 to be easily attached and removed from the rods 14. According, after the curtain system 10 (e.g., the rods 14, the buckle assemblies 100, and the curtain 12) is initially installed, the user can replace the existing curtain by taking it down and replacing it with the new curtain in the curtain assembly 200. The new curtain assembly 200 is installed by attaching it (e.g., the plurality of lower buckle parts 140) to the plurality of upper buckle parts 102 already connected to the rods 14. The curtain assembly 200 is shown folded and contained within a package 202. The package 202 can be made of any suitable material and of any suitable construction. For example, the package 202 can be a closed plastic bag. The curtain 12 is folded lengthwise and widthwise in the package 202. Preferably, as shown in the illustrated embodiment, the curtain 12 is in a folded configuration in the package 202 such that the plurality of lower buckle parts 140 are arranged in the same order as the order of the order of the plurality of lower buckle parts on the curtain when the curtain is in the unfolded configuration, as shown in FIG. 1. More preferably, the lower buckle parts 140 are in the same order they would be when the curtain 12 is unfolded as when the curtain 12 is folded and lying generally flat and are all oriented in the same direction. This makes it easier to install the curtain assembly 200 by allowing the curtain assembly to be connected to the upper buckle parts 102 while still in the folded configuration. An accordion fold may be used to arranged the lower buckle parts 140 in order in the folded configuration. The according fold may be even or uneven (e.g., have different lengths between folds) to properly order the lower buckle parts 140. The buckle assemblies 100 may be stacked one on top another in the folded configuration (as illustrated) or side-by-side in the folded configuration (not shown). The order of the lower buckle parts 140 in the folded (FIG. 9) and unfolded (FIG. 1) configurations is designated by the position identifiers A-G in FIGS. 1 and 9. The lower end of the curtain 12 is preferably also folded up to place the curtain assembly 200 in a relatively compact shape when in the folded configuration, as illustrated. The lower end of the curtain 12 may be folded up one or more times.

It is understood the buckle assembly 100 and associated teachings herein may be used in other contexts besides suspending a curtain 12 from a rod 14. For example, the buckle assembly may be configured to connect two straps together.

While particular elements, embodiments, and applications of the present disclosure have been shown and described, it is understood that the disclosure is not limited thereto because modifications may be made by those skilled in the art, particularly in light of the foregoing teaching. It is therefore contemplated by the appended claims to cover such modifications and incorporate those features which come within the spirit and scope of the disclosure.

Having described the disclosure in detail, it will be apparent that modifications and variations are possible without departing from the scope of the disclosure defined in the appended claims.

When introducing elements of the present disclosure or the preferred embodiments(s) thereof, the articles "a", "an", "the" and "said" are intended to mean that there are one or more of the elements. The terms "comprising", "including" and "having" are intended to be inclusive and mean that there may be additional elements other than the listed elements.

In view of the above, it will be seen that the several objects of the disclosure are achieved and other advantageous results attained.

As various changes could be made in the above constructions, products, and methods without departing from the scope of the disclosure, it is intended that all matter contained in the above description and shown in the accompanying drawings shall be interpreted as illustrative and not in a limiting sense.

What is claimed is:

1. A buckle assembly for suspending a curtain from a support, the buckle assembly comprising:

an upper buckle part having an upper buckle part body and a support connector attached to the upper buckle part body and configured to attach the upper buckle part to the support, the upper buckle part having first and second finger rests, the first finger rest extending outward from a first side of the upper buckle part body and the second finger rest extending outward from a second side of the upper buckle part body, the first finger rest being sized and shaped to be engaged by a first finger of a user and the second finger rest being sized and shaped to be engaged by a second finger of the user; and a lower buckle part having a lower buckle part body configured to be attached to the curtain, the lower buckle part body includes a thumb receptacle sized and shaped to receive a thumb of the user;

wherein one of the upper buckle part or the lower buckle part includes a buckle part connector configured to engage the other of the upper buckle part or the lower buckle part to couple the upper and lower buckle parts together, and wherein the thumb receptacle of the lower buckle part is unobstructed when the upper and lower buckles parts are coupled together.

2. The buckle assembly of claim 1, wherein the buckle part connector comprises a snap-fit connector, the snap-fit connector configured to form a snap-fit connection with said other of the upper buckle part or the lower buckle part when the upper and lower buckle parts are squeezed together by the thumb, first finger and second finger of the user.

3. The buckle assembly of claim 1, wherein the first and second finger rests each includes a finger support surface configured to be engaged by the respective first and second fingers, each finger support surface being arcuate.

4. The buckle assembly of claim 3, wherein each finger support surface is concave.

5. The buckle assembly of claim 1, wherein the first and second finger rests are symmetrical about an imaginary axis, the imaginary axis extending through the center of the thumb receptacle when the upper and lower buckle parts are coupled together.

6. The buckle assembly of claim 1, wherein the lower buckle part includes the buckle part connector, the buckle part connector configured to engage the upper buckle part to couple the upper and lower buckle parts together.

7. The buckle assembly of claim 1, wherein the support connector includes a post configured to be inserted into the support and at least one latch member supported by the post and configured to engage and form a latched connection with the support to attach the upper buckle part to the support.

8. The buckle assembly of claim 7, wherein the at least one latch member includes first and second latch members.

9. The buckle assembly of claim 8, wherein the post includes first and second spaced apart post segments, the first post segment supporting the first latch member and the second post segment supporting the second latch member.

10. The buckle assembly of claim 1, in combination with the curtain.

11. The combination of claim 10, further comprising a curtain connector attaching the curtain to the lower buckle part body.

12. The combination of claim 10, in further combination with the support, the support connector of the upper buckle part being attached to the support.

13. The buckle assembly of claim 1, wherein the thumb receptacle is spaced apart from the first finger rest and the second finger rest when the upper and lower buckles parts are coupled together.

14. The buckle assembly of claim 1, wherein the upper buckle part has opposite first and second end portions, the first end portion including the first and second finger rests, the second end portion being configured to couple to the lower buckle part.

15. The buckle assembly of claim 14, wherein the second end portion of the upper buckle part includes a space sized and shaped to receive the lower buckle part to couple to upper and lower buckle parts together.

16. A buckle assembly for suspending a curtain from a support, the buckle assembly comprising:

an upper buckle part having an upper buckle part body and a support connector attached to the upper buckle part body and configured to attach the upper buckle part to the support, the upper buckle part having first and second finger rests, the first finger rest extending outward from a first side of the upper buckle part body and the second finger rest extending outward from a second side of the upper buckle part body, the first finger rest being sized and shaped to be engaged by a first finger of a user and the second finger rest being sized and shaped to be engaged by a second finger of the user; and a lower buckle part having a lower buckle part body configured to be attached to the curtain, the lower buckle part body includes a thumb receptacle sized and shaped to receive a thumb of the user;

wherein one of the upper buckle part or the lower buckle part includes a buckle part connector configured to engage the other of the upper buckle part or the lower buckle part to couple the upper and lower buckle parts together, and wherein the thumb receptacle is spaced apart from the first finger rest and the second finger rest when the upper and lower buckles parts are coupled together.

17. The buckle assembly of claim 16, wherein the thumb receptacle is sized and shaped to permit the thumb of the user to be inserted there-through.

18. A buckle assembly for suspending a curtain from a support, the buckle assembly comprising:

an upper buckle part having an upper buckle part body and a support connector attached to the upper buckle part body and configured to attach the upper buckle part to the support, the upper buckle part having first and second finger rests, the first finger rest extending outward from a first side of the upper buckle part body and the second finger rest extending outward from a second side of the upper buckle part body, the first finger rest being sized and shaped to be engaged by a first finger of a user and the second finger rest being sized and shaped to be engaged by a second finger of the user; and a lower buckle part having a lower buckle part body configured to be attached to the curtain, the lower buckle part body includes a thumb receptacle sized and shaped to receive a thumb of the user;

wherein one of the upper buckle part or the lower buckle part includes a snap-fit connector configured to form a snap-fit connection with the other of the upper buckle part or the lower buckle part to couple the upper and lower buckle parts together when the upper and lower buckle parts are squeezed together by the thumb, first finger and second finger of the user.

19. The buckle assembly of claim 18, wherein the lower buckle part includes the snap-fit connector, and wherein the upper buckle part includes a space configured to receive the snap-fit connector to couple the upper and lower buckle parts together.

20. The buckle assembly of claim 18, wherein the upper and lower buckle parts are configured such that the lower buckle part moves along an axis relative to the upper buckle part when the upper and lower buckle parts are squeezed together by the thumb, first finger and second finger of the user to couple the upper and lower buckle parts together, and wherein the thumb receptacle is spaced apart along the axis from the first finger rest and the second finger rest when the upper and lower buckles parts are coupled together.

* * * * *